US007468026B2

(12) United States Patent
Lo

(10) Patent No.: US 7,468,026 B2
(45) Date of Patent: Dec. 23, 2008

(54) SEAT ADJUSTING MECHANISM OF EXERCISE MACHINES

(76) Inventor: Chiu Hsiang Lo, No. 37-2, Ching-Dau 1st Street, Taichung (TW) 404

( * ) Notice: Subject to any disclaimer, the term of this patent is extended or adjusted under 35 U.S.C. 154(b) by 0 days.

(21) Appl. No.: 11/743,792

(22) Filed: May 3, 2007

(65) Prior Publication Data

US 2008/0274864 A1 Nov. 6, 2008

(51) Int. Cl.
*A63B 26/00* (2006.01)

(52) U.S. Cl. ..... 482/142; 297/195.1

(58) Field of Classification Search ..... 482/142, 482/72, 140, 148; 297/1, 13, 195.1, 232
See application file for complete search history.

(56) References Cited

U.S. PATENT DOCUMENTS 6,264,586 B1 * 7/2001 Webber ..... 482/104

FOREIGN PATENT DOCUMENTS

TW 094220889 6/2006

* cited by examiner

*Primary Examiner*—Lori Amerson
(74) *Attorney, Agent, or Firm*—WPAT, P.C.; Anthony King

(57) ABSTRACT

A seat adjusting mechanism of an exercise machine, of which a sliding rack is provided at bottom side of the seat that is moved relatively against the frame and an adjusting mechanism is arranged in-between a frame and a sliding rack of a seat, which is used to adjust and fix positions of the seat. The adjusting mechanism comprises a clamp-bearing member that extends to the frame and is installed on the location that the seat slides, and a clamping device that includes two clamp arms pivotally installed side by side on the sliding rack. The two clamp arms have their first ends being clamping parts that clamp on the clamp-bearing member, and their second ends being force-bearing parts that are receive foreign forces to have the clamping parts of the two clamp arms clamp with each other so as to clamp on the clamp-bearing member.

10 Claims, 7 Drawing Sheets

SEAT ADJUSTING MECHANISM OF EXERCISE MACHINES

FIELD OF THE INVENTION

The present invention relates to a kind of seat adjusting mechanism of an exercise machine, and more particularly to an adjusting mechanism arranged in-between a frame and a sliding rack of a seat of an exercise machine, which is used to adjust and fix positions of the seat. The adjusting mechanism comprises a clamp-bearing member and a clamping device such that the clamping device can receive foreign forces to clamp on the clamp-bearing member, and then the seat will have function of positions adjustment.

BACKGROUND OF THE INVENTION

A conventional seat adjusting mechanism of an exercise machine, as shown in FIGS. 6 and 7, comprises a base frame 70 and a seat 73 that can slide on the base frame 70. A positioning mechanism 7 is provided in-between the seat 73 and the base frame 70 for positioning the seat within the pre-determined location of its moving range, which comprises a gear rack 71 fixed on the base frame 70 on which a plurality of dents 72 are provided therealong, a fit-in block 74 that pushed by a spring 77 and has a plurality concavities 78 for the dents 72 of the gear rack 71 to match with, and a lever 75 that is pivotally installed on the seat 73. One end of the lever 75 is connected to the fit-in block 74 and the other end of the lever 75 has a levering handle 76 for users to activate the mechanism. The conventional structure by activating the lever 75 for having the concavities 78 of the fit-in block 74 fitted, or not fitted, with the dents 72 of the gear rack 71. When the concavities 78 are fitted with dents 72, the seat 73 is fixed with the base frame 70 and cannot be moved. When the concavities 78 are not fitted with dents 72, users are able to adjust the location of the seat 73 relatively to the base frame 70. Because gear rack is of high price so the cost is high, besides, there is a certain distance between two dents such that adjustment tuning cannot be effectively achieved. Furthermore, the concavities and the dents are easy to get damaged because they contact with each other during fitting-in.

SUMMARY OF THE INVENTION

The primary objective of the present invention is to provide a kind of exercise machine that has a seat adjusting mechanism with firmness, better structural strength, force-saving operation and durability. The seat adjusting mechanism consists of a clamp-bearing member extending to the frame relative sliding locations of the seat, and a clamping device including two clamp arms that are pivotally installed side by side on the sliding rack. The two clamp arms have their first ends being clamping parts clamped on the clamp-bearing member, and their second ends being force-bearing parts that are receive foreign forces to have the clamping parts of the two clamp arms clamp with each other and clamp on the clamp-bearing member. With controlling of closing or opening the clamping device, the seat can be adjusted in locations and fixed, and then the objectives of increasing firmness, durability, safety and operational convenience are achieved.

The present invention will become more obvious from the following description when taken in connection with the accompanying drawings that show, for purposes of illustration only, a preferred embodiment in accordance with the present invention.

DETAILED DESCRIPTION OF THE PREFERRED EMBODIMENT

Figure 1:
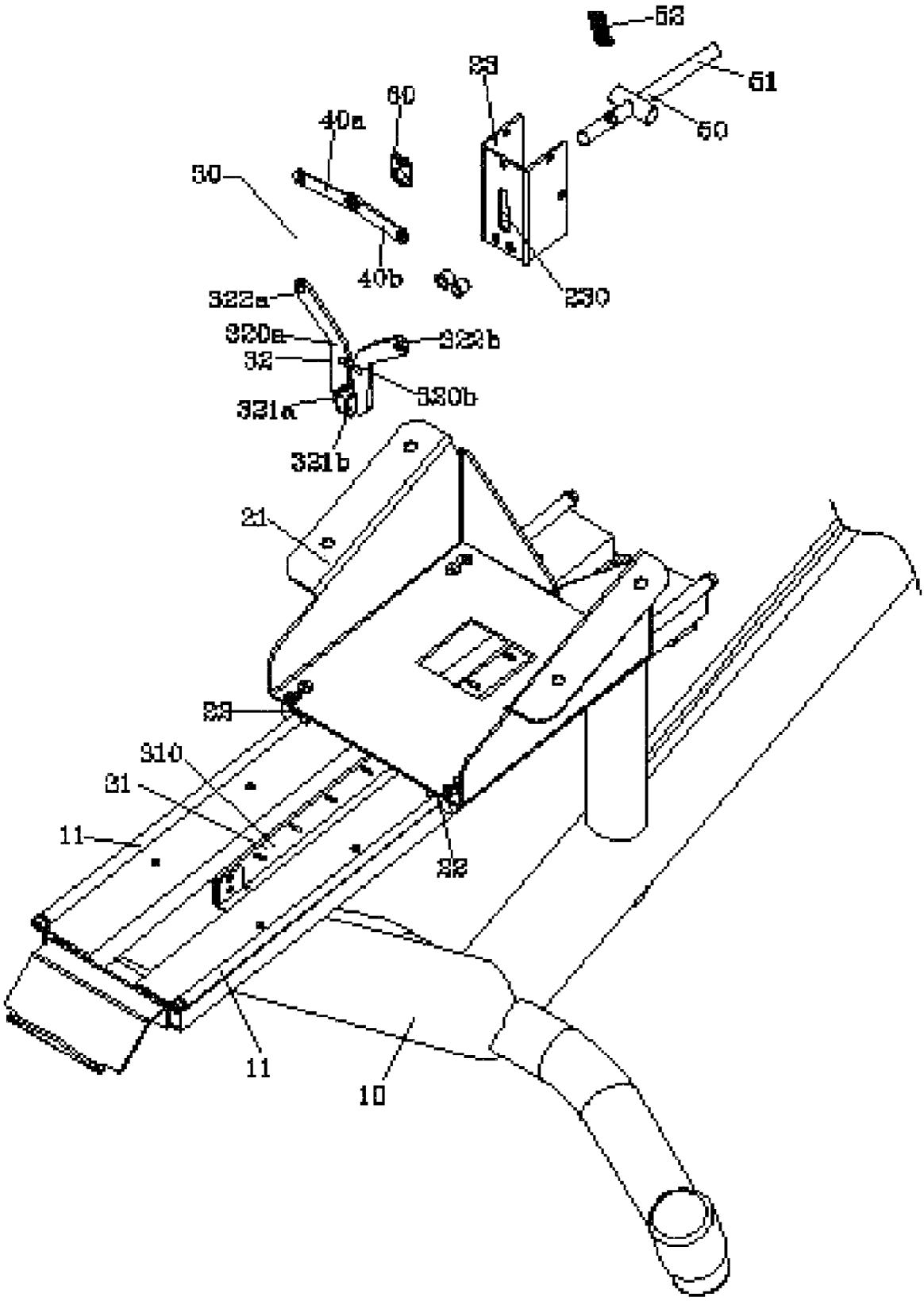
FIG. 1 is an exploded view of the basic structure of the present invention.
Figure 2:
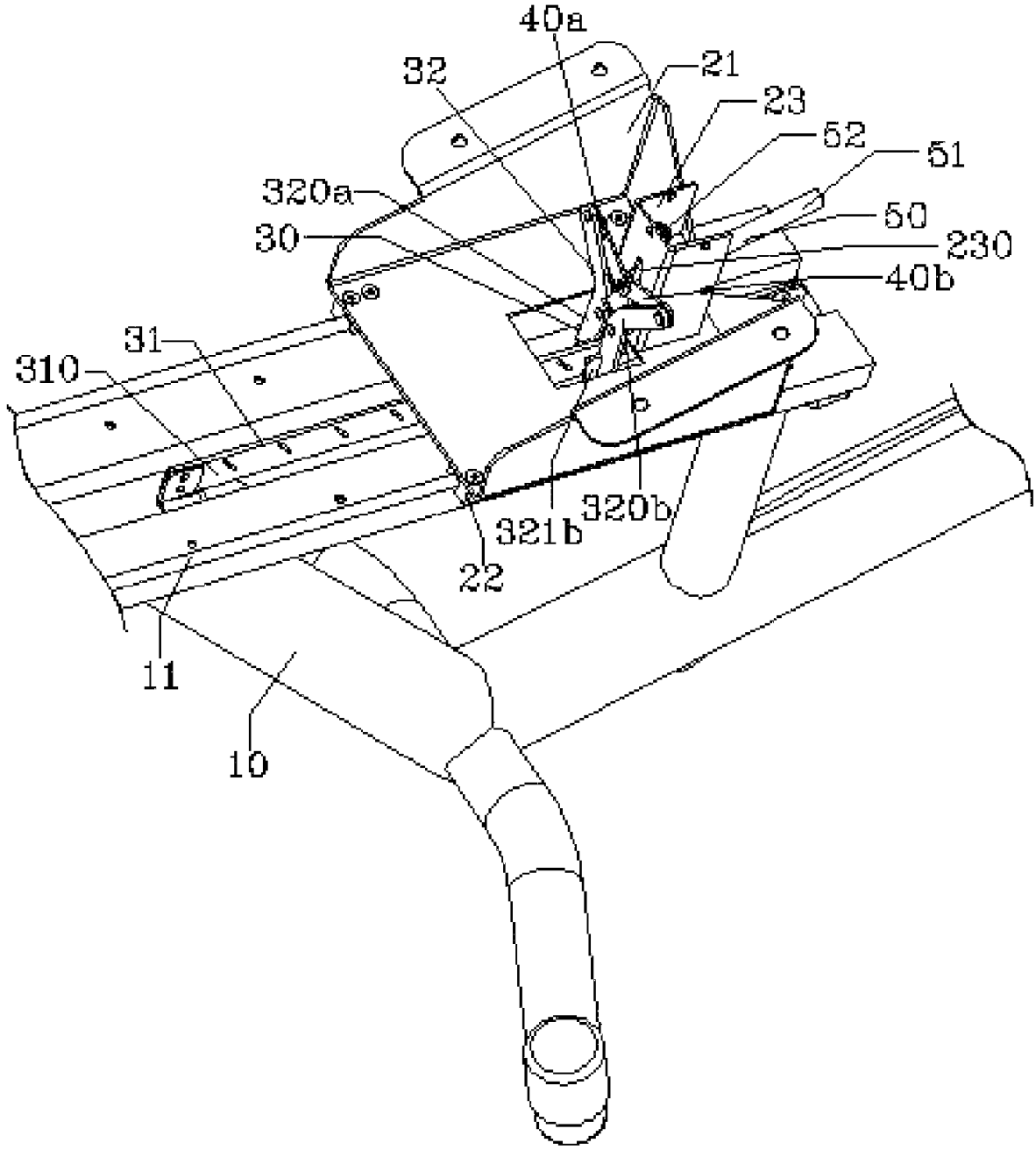
FIG. 2 is a perspective view showing the clamping device of the present invention is open.
Figure 3:
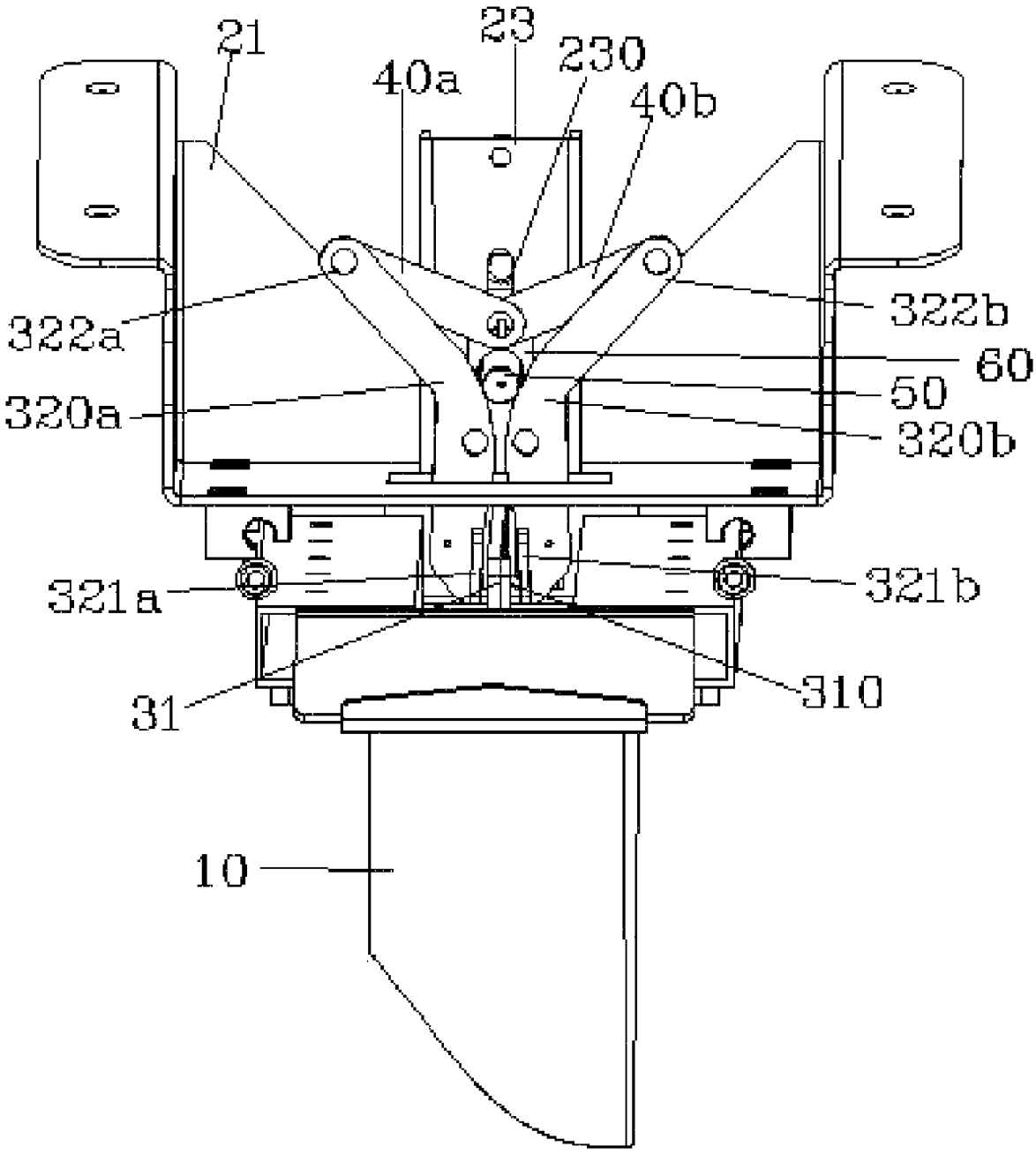
FIG. 3 is a front view showing the clamping device of the present invention is open.

The technique of the present invention is about a seat adjusting mechanism of an exercise machine that can be an exercise bicycle or any other exercise gear with seat. Referring to FIGS. 1 to 3 for the seat adjusting mechanism of the present invention, the basic structure of the embodiment comprises a frame 10, a seat 20 and an adjusting mechanism 30.

A sliding rack 21 is provided on bottom side of the seat 20, which is slidablly moved relatively to the frame 10.

The adjusting mechanism 30 is installed in-between the frame 10 and the sliding rack 21 of the seat 20 for adjusting and fixing the location of the seat 20. The adjusting mechanism 30 includes a clamp-bearing member 31 and a clamping device 32.

The clamp-bearing member 31 is fixed on the frame 10 and extending along the frame 10, and is installed on the location that the seat 20 can slide therealong.

The clamping device 32 includes two clamp arms 320*a*, 320*b* that are pivotally installed side by side on the sliding rack 21. The two clamp arms 320*a*, 320*b* have their first ends being clamping parts 321*a*, 321*b* that can clamp with each other so as to clamp the clamp-bearing member 31, and their second ends being force-bearing parts 322*a*, 322*b* that are received foreign forces to have the clamping parts 321*a*, 321*b* of the two clamp arms 320*a*, 320*b* clamp with each other so as to clamp the clamp-bearing member 31.

Referring to FIGS. 1 to 5, in the embodiment of the present invention, the two sides of the clamp-bearing member 31 each has a guide rail 11 on the frame 10, additionally, the sliding rack 21 is equipped with guide grooves 22 that are fitted with the guide rails 11 on the frame 10, such that the sliding rack 21 is sliding relatively to the frame 10.

Referring to FIGS. 1 to 3, in the embodiment of the present invention, the clamp-bearing member 31 is a piece of plate with a certain extended length, the two sides of the piece of plate have clamp-bearing surfaces 310 for the clamping parts 321*a*, 321*b* of the two clamp arms 320*a*, 320*b* of the clamping device 32 to clamp on.

Referring to FIGS. 1 to 3, in the embodiment of the present invention, to reinforce the ease in operation, each of the force-bearing parts 322*a*, 322*b* of the clamp arms 320*a*, 320*b* is respectively connected pivotally with the first ends of connecting rods 40*a*, 40*b*, and the second ends of the connecting rods 40*a*, 40*b* pivotally are connected with each other. A leveling rod 50 is pivotally connected to the sliding rack 21, the first end of the leveling rod 50 has a handle 51 for users to apply their forces, the second end of the leveling rod 50 interlocks with the second ends of the connecting rods 40*a*,

40*b* that are pivotally connected with the force-bearing parts 322*a*, 322*b* of the two clamp arms 320*a*, 320*b*. Users can apply their forces on the leveling rod 50 to interlock the two clamp arms 320*a*, 320*b* via the connecting rods 40*a*, 40*b*, and then the status of the clamping parts 321*a*, 321*b* of the two clamp arms 320*a*, 320*b* can be controlled close or open. In one of the preferred embodiment of the present invention, the second end of the leveling rod 50 is connected with a connecting plate 60 that is connected to the second ends of the connecting rods 40*a*, 40*b*, so that the leveling rod 50 could be easily connected to the connecting rod 40*a*, 40*b*.

Referring to FIG. 1, in the embodiment of the present invention, a spring 52 is installed in-between the leveling rod 52 and the sliding rack 21 such that the leveling rod 50 would have elasticity to get restored.

Referring to FIGS. 1 to 3, in the embodiment of the present invention, the sliding rack 21 is equipped with a positioning base 23 that has an adjustment hole 230 for the second end of the leveling rod 50 to penetrate and move up and down. The positioning base 23 is used for the leveling rod 50 to be pivotally connected.

Figure 4:
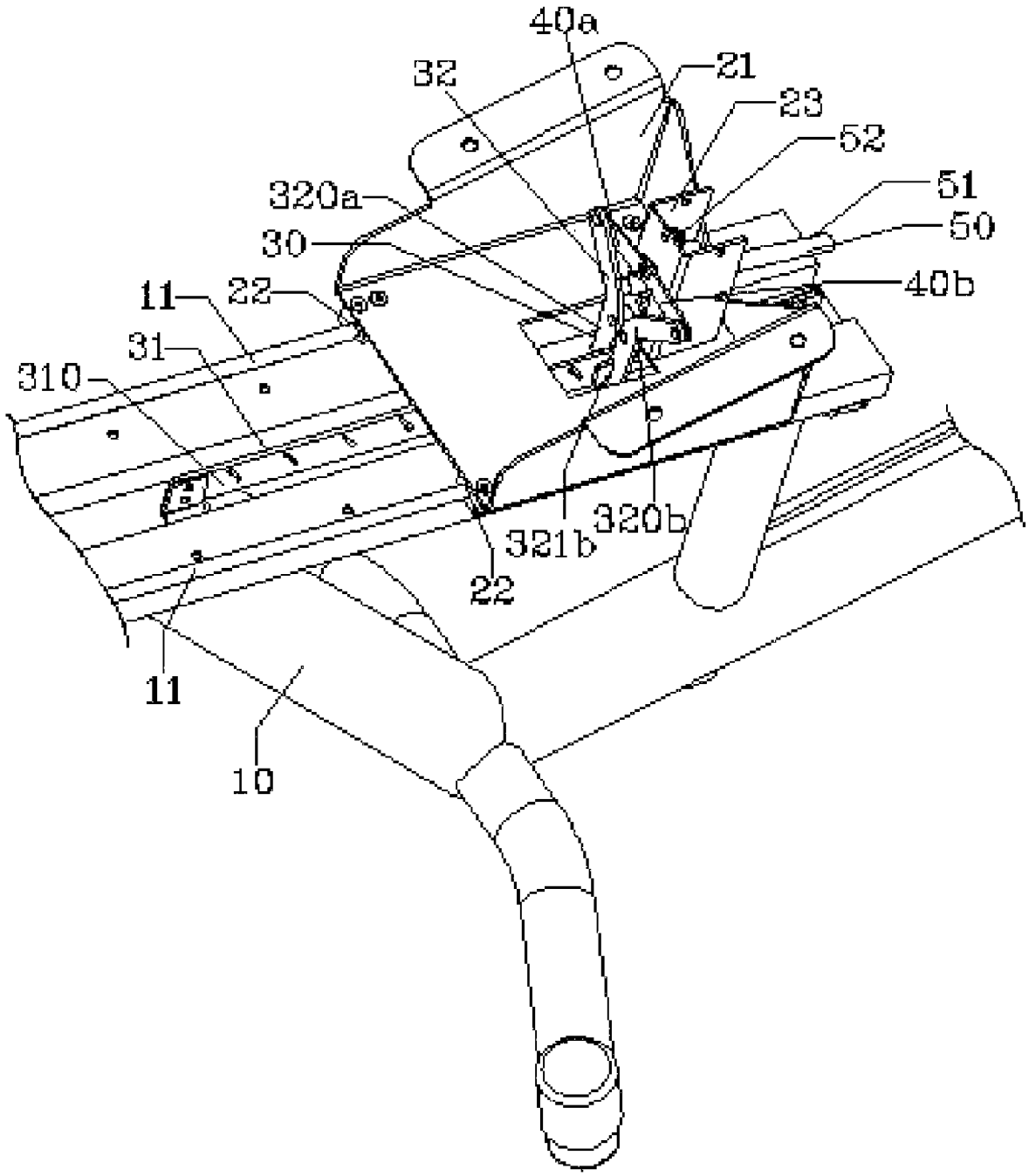
FIG. 4 is a perspective view showing the clamping device of the present invention is clamped.
Figure 5:
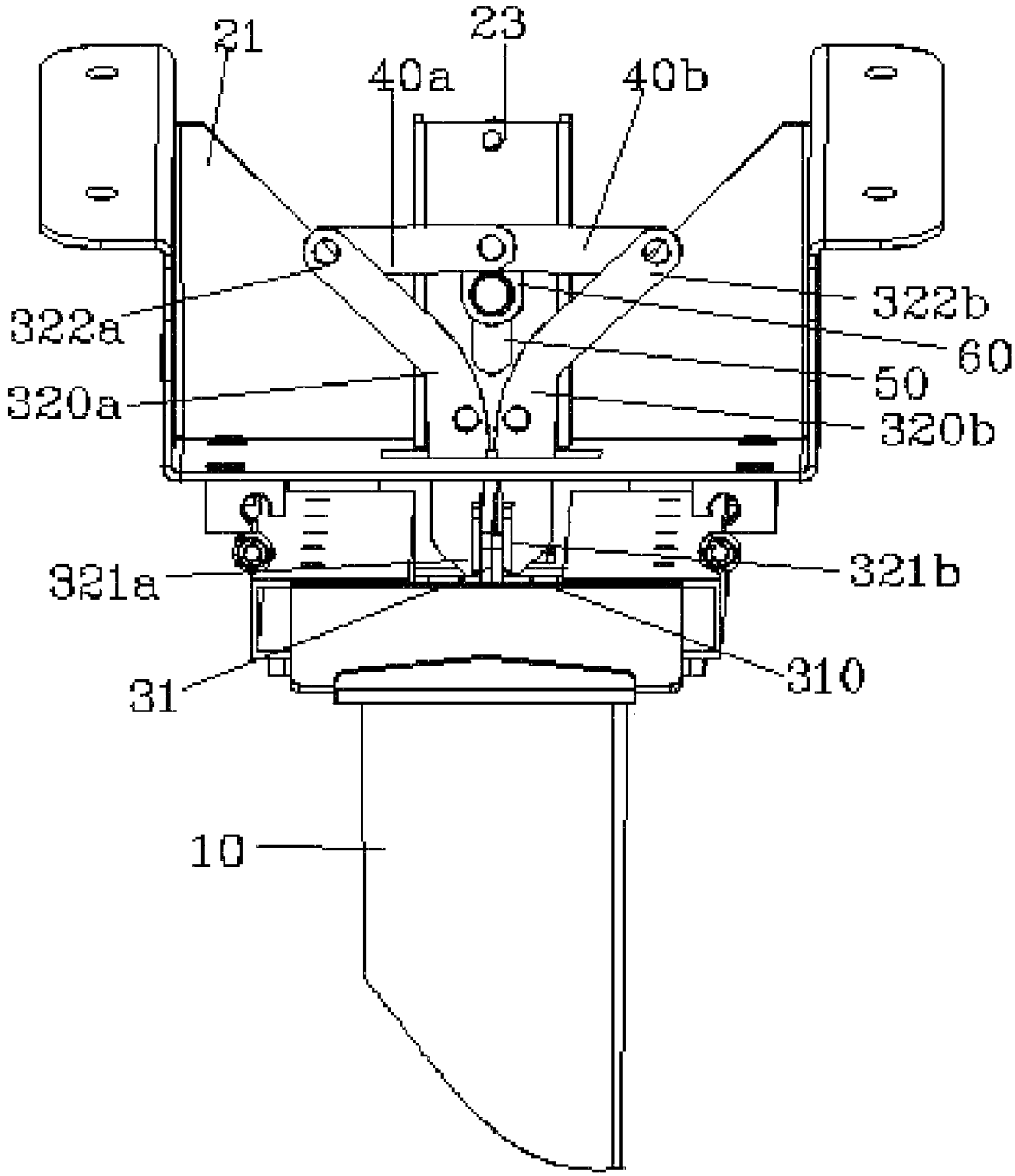
FIG. 5 is a front view showing the clamping device of the present invention is clamped.
Figure 6:
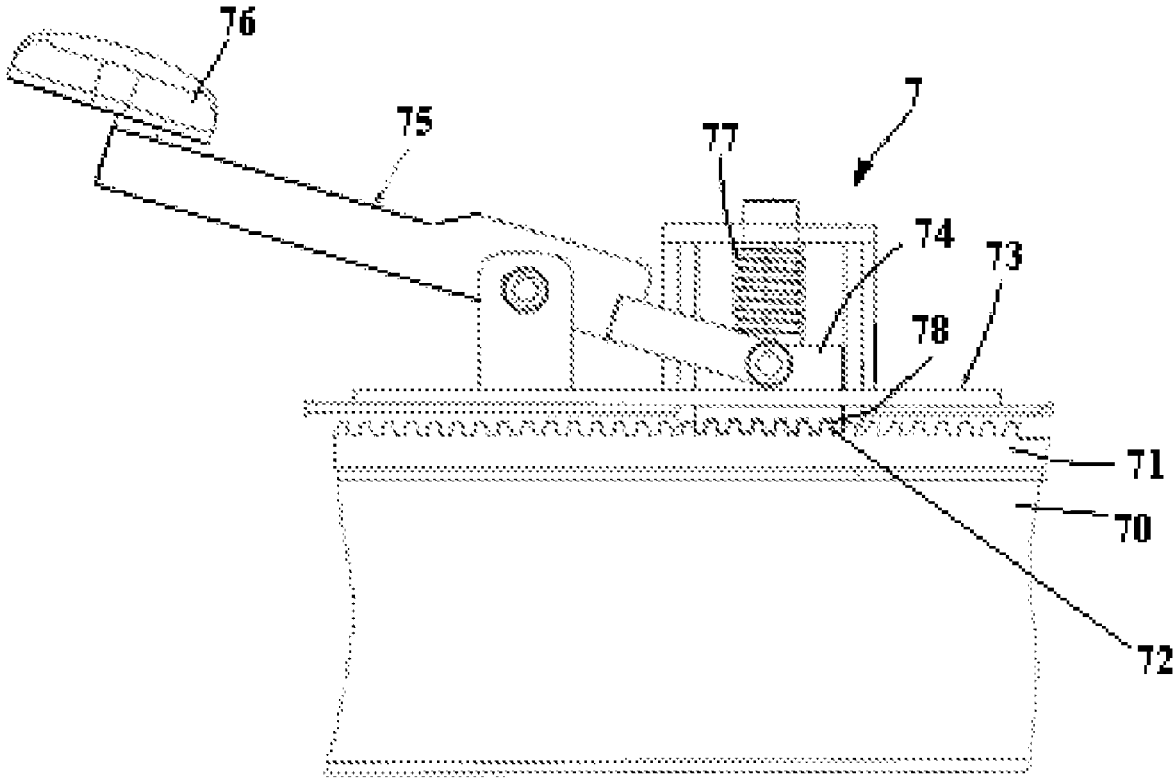
PRIOR ART FIG. 6
FIG. 6 is a large scale of side view showing a conventional clamping device of a exerciser.
Figure 7:
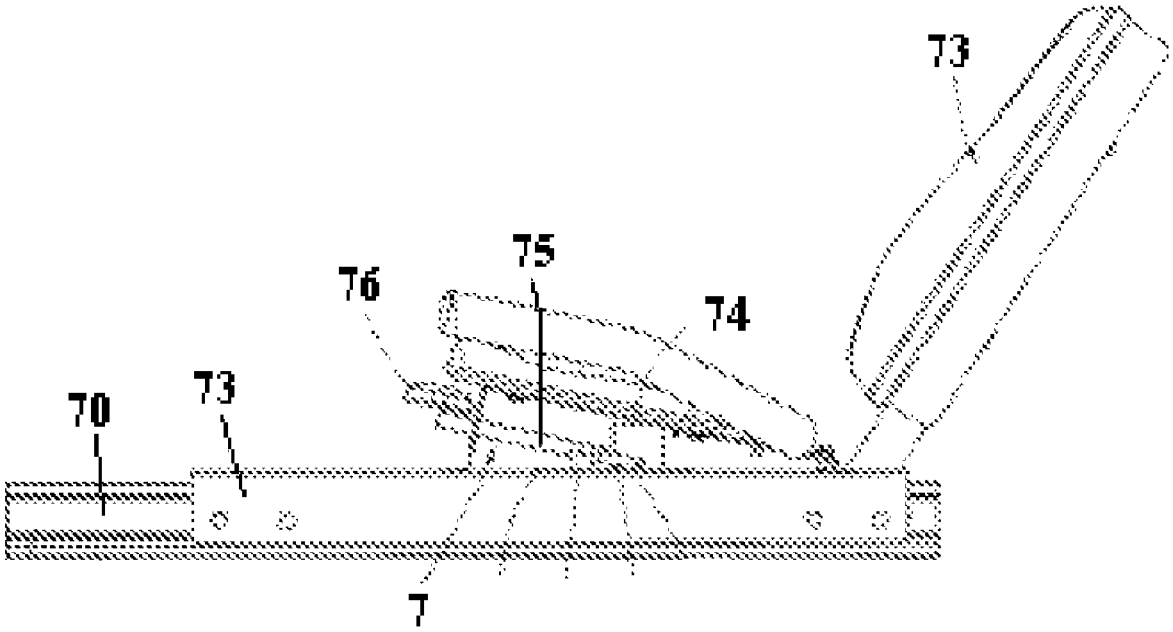
PRIOR ART FIG. 7
FIG. 7 is a complete view showing the conventional device of FIG. 6 with a seat of the exerciser.

Referring to FIGS. 2 to 4, in a preferred embodiment of the present invention, to operate the seat 20 to adjust the location, users just have to pull up the leveling rod 50 that is pivotally installed on the positioning base 23. Meanwhile the connection point of the positioning base 23 with the leveling rod 50 would be as a pivot for the second end of the leveling rod 50 being moved downward, and then the connecting plate 60 being moved downward making the second ends of the two connecting rods 40*a*, 40*b* moved downward. The force-bearing parts 322*a*, 322*b* of the two clamp arms 320*a*, 320*b* are pushed toward each other by the two connecting rods 40*a*, 40*b*. Relatively, the clamping parts 321*a*, 321*b* of the two clamp arms 320*a*, 320*b* are moved away from each other and leave from the clamp-bearing surfaces 310 on both sides of the clamp-bearing member 31. At the moment users can push the sliding rack 21 of the seat 20 moving forward or backward relatively to the frame 10 along the guide rails 11. Referring to FIGS. 4 to 5, when the seat 20 is pushed to arrive the desired location, users want to fix the seat 20, all they have to do is to push down the handle 51 of the leveling rod 50, the second end of the leveling rod 50 is moved upward and the connecting plate 60 is moved upward as well making the two connecting rods 40*a*, 40*b* move upward. The force-bearing parts 322*a*, 322*b* of the two clamp arms 320*a*, 320*b* are pulled away from each other by the two connecting rods 40*a*, 40*b*. Relatively, the clamping parts 321*a*, 321*b* of the two clamp arms 320*a*, 320*b* are moved toward each other and clamp on the clamp-bearing surfaces 310 on both sides of the clamp-bearing member 31. Thus the sliding rack 21 together with the seat 20 is fixed on the frame 10, and then the functions of adjustment and fixing of the seat 20 are effectively achieved.

Therefore, with use of the above-mentioned structural design, the present invention surely has the advantages of increased firmness, better structural strength, higher product durability, and effort saving in seat adjustment.

While we have shown and described the embodiment in accordance with the present invention, it should be clear to those skilled in the art that further embodiments may be made without departing from the scope of the present invention.

What is claimed is:

1. A seat adjusting mechanism of an exercise machine comprising:

a frame;

a seat equipped with a sliding rack on the bottom of the seat slidably moved relatively to the frame; and an adjusting mechanism installed in-between the frame and the sliding rack of the seat for adjusting and fixing a location of the seat, wherein the adjusting mechanism including:

a clamp-bearing member fixed on the frame and extending along the frame, and installed on a location that the seat slides therealong, wherein the clamp-bearing member is a piece of plate with a extended length, two sides of the piece of plate having clamp-bearing surfaces; and a clamping device including two clamp arms pivotally installed side by side on the sliding rack, first ends of the two clamp arms being clamping parts clamping with each other so as to clamp the clamp-bearing member, second ends of the two clamp arms being force-bearing parts that are received foreign forces to have the clamping parts of the two clamp arms clamp with each other so as to clamp on the clamp-bearing surfaces of the clamp-bearing member

2. The seat adjusting mechanism of an exercise machine as claimed in claim 1, wherein the frame has two guide rails each respectively located adjacent two sides of the clamp-bearing member, the sliding rack equipped with guide grooves that are fitted with the guide rails of the frame for the sliding rack sliding relatively to the frame.

3. The seat adjusting mechanism of an exercise machine as claimed in claim 1, wherein each of the force-bearing parts of the clamp arms is respectively connected pivotally with first ends of connecting rods and the sliding rack is equipped with a leveling rod, a first end of the leveling rod having a handle for users to apply their forces, a second end of the leveling rod interlocking with second ends of the connecting rods that are pivotally connected with the force-bearing parts of the two clamp arms, users can apply their forces on the leveling rod to interlock the two clamp arms via the connecting rods, to control the status of the clamping parts of the two clamp arms being close or open.

4. The seat adjusting mechanism of an exercise machine as claimed in claim 3, wherein the second end of the leveling rod is connected with a connecting plate that is connected to second ends of the connecting rods.

5. The seat adjusting mechanism of an exercise machine as claimed in claim 3, wherein a spring is installed in-between the leveling rod and the sliding rack such that the leveling rod has elasticity to get restored.

6. The seat adjusting mechanism of an exercise machine as claimed in claim 3, wherein the sliding rack is equipped with a positioning base with an adjustment hole for the second end of the leveling rod to penetrate and move up and down, the positioning base used for the leveling rod to be pivotally connected thereto.

7. A seat adjusting mechanism of an exercise machine comprising:

a frame;

a seat equipped with a sliding rack on the bottom of the seat slidably moved relatively to the frame; and an adjusting mechanism installed in-between the frame and the sliding rack of the seat for adjusting and fixing a location of the seat, wherein the adjusting mechanism including:

a clamp-bearing member fixed on the frame and extending along the frame, and installed on a location that the seat slides therealong; and a clamping device including two clamp arms pivotally installed side by side on the sliding rack, first ends of the two clamp arms being clamping parts clamping with each other so as to clamp the clamp-bearing member, second ends of the two clamp arms being force-bearing pans that are received foreign forces to have the clamping parts of the two clamp arms clamp with each other so as to clamp the clamp-bearing member, wherein each of the force-bearing parts of the clamp arms is respectively connected pivotally with first ends of connecting rods and the sliding rack is equipped with a leveling rod, a first end of the leveling rod having a handle for users to apply their forces, a second end of the leveling rod interlocking with second ends of the connecting rods that are pivotally connected with the force-bearing pans of the two clamp arms, users can apply their forces on the leveling rod to interlock the two clamp arms via the connecting rods, to control the status of the clamping parts of the two clamp arms being close or open.

8. The seat adjusting mechanism of an exercise machine as claimed in claim 7, wherein the second end of the leveling rod is connected with a connecting plate that is connected to second ends of the connecting rods.

9. The seat adjusting mechanism of an exercise machine as claimed in claim 7, wherein a spring is installed in-between the leveling rod and the sliding rack such that the leveling rod has elasticity to get restored.

10. The seat adjusting mechanism of an exercise machine as claimed in claim 7, wherein the sliding rack is equipped with a positioning base with an adjustment hole for the second end of the leveling rod to penetrate and move up and down, the positioning base used for the leveling rod to be pivotally connected thereto.

* * * * *